US008618430B2

(12) United States Patent
Staffas et al.

(10) Patent No.: US 8,618,430 B2
(45) Date of Patent: Dec. 31, 2013

(54) SPRING OPERATED ACTUATOR FOR AN ELECTRICAL SWITCHING APPARATUS

(75) Inventors: Daniel Staffas, Ludvika (SE); Johannes Tredoux, Ludvika (SE); Mats Holman, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/463,324

(22) Filed: May 3, 2012

(65) Prior Publication Data

US 2012/0228103 A1 Sep. 13, 2012

Related U.S. Application Data

(63) Continuation of application No. PCT/EP2010/066367, filed on Oct. 28, 2010.

(30) Foreign Application Priority Data

Nov. 3, 2009 (EP) ..... 09174919

(51) Int. Cl.
*H01H 3/00* (2006.01)

(52) U.S. Cl.
USPC ..... 200/329

(58) Field of Classification Search
USPC ..... 200/329, 400, 401, 501, 17 R, 538
See application file for complete search history.

(56) References Cited

U.S. PATENT DOCUMENTS

| | | | | |
|---|---|---|---|---|
| 4,162,385 | A | 7/1979 | Bould et al. | |
| 4,678,877 | A | 7/1987 | Nicoloso | |
| 5,280,258 | A | 1/1994 | Opperthauser | |
| 5,571,255 | A | 11/1996 | Baginski et al. | |
| 6,337,449 | B1 * | 1/2002 | Brouillat et al. | 200/400 |
| 6,444,934 | B1 | 9/2002 | Imura et al. | |
| 6,667,452 | B2 | 12/2003 | Spiegel | |
| 7,772,513 | B2 * | 8/2010 | Ohda et al. | 200/400 |
| 2003/0015499 | A1 | 1/2003 | Kawamoto et al. | |

FOREIGN PATENT DOCUMENTS

| | | | |
|---|---|---|---|
| DE | 102008026798 | B3 | 7/2009 |
| EP | 1901324 | B1 | 6/2011 |

OTHER PUBLICATIONS

European Search Report; Application No. EP 09 17 4919; Issued: Apr. 1, 2010; Mailing Date: Apr. 9, 2010; 5 pages.
International Preliminary Report on Patentability; Application No. PCT/EP2010/066367; Issued: Mar. 8, 2012; 6 pages.
International Search Report & Written Opinion of the International Searching Authority; Application No. PCT/EP2010/066367; Issued: Jan. 21, 2011; Mailing Date: Jan. 27, 2011; 8 pages.
Written Opinion of the International Preliminary Examining Authority; Application No. PCT/EP2010/066367; Mailing Date: Feb. 2, 2012; 5 pages.

* cited by examiner

*Primary Examiner* — Edwin A. Leon
(74) *Attorney, Agent, or Firm* — St. Onge Steward Johnston & Reens LLC

(57) ABSTRACT

A spring operated actuator for an electrical switching apparatus. The actuator has a main shaft transmitting the actuation movement to the switching apparatus and has opening spring means and closing spring means. The opening spring means includes an opening torsion spring and the closing means includes a closing torsion spring. The axes of the torsion springs extend in the same direction and at a distance from each other that is less than 20% of the external opening spring diameter.

19 Claims, 9 Drawing Sheets

SPRING OPERATED ACTUATOR FOR AN ELECTRICAL SWITCHING APPARATUS

CROSS-REFERENCE TO RELATED APPLICATIONS

The present application is a continuation of pending International patent application PCT/EP2010/066367 filed on Oct. 28, 2010 which designates the United States and claims priority from European patent application 09174919.2 filed on Nov. 3, 2009. The content of all prior applications is incorporated herein by reference.

FIELD OF THE INVENTION

The present invention relates to a spring operated actuator for an electrical switching apparatus, the spring operated actuator including a rotary drive main shaft arranged to transmit an actuating movement to the switching apparatus, an opening spring means and a closing spring means.

BACKGROUND OF THE INVENTION

In a power transmission or distribution network, switching apparatuses are incorporated into the network to provide automatic protection in response to abnormal load conditions or to permit opening or closing (switching) of sections of the network. The switching apparatus may therefore be called upon to perform a number of different operations such as interruption of terminal faults or short line faults, interruption of small inductive currents, interruption of capacitive currents, out-of-phase switching or no-load switching, all of which operations are well known to a person skilled in the art.

In switching apparatuses the actual opening or closing operation is carried out by two contacts where normally one is stationary and the other is mobile. The mobile contact is operated by an operating device which comprises an actuator and a mechanism, where said mechanism operatively connects the actuator to the mobile contact.

Actuators of known operating devices for medium and high voltage switches and circuit breakers are of the spring operated, the hydraulic or the electromagnetic type. In the following, operating devices will be described operating a circuit breaker but similar known operating devices may also operate switches.

A spring operated actuator, or spring drive unit as it is also called, generally uses two springs for operating the circuit breaker; an opening spring for opening the circuit breaker and a closing spring for closing the circuit breaker and reloading the opening spring. Instead of just one spring for each one of the opening spring and the closing spring, sometimes a set of springs may be used for each one of the opening spring and the closing spring. For example, such a set of springs may include a small spring arranged inside a larger spring or two springs arranged in parallel, side by side. In the following, it should be understood that when reference is made to the spring of the respective opening spring and the closing spring, such a spring could include a set of springs. Another mechanism converts the motion of the springs into a translation movement of the mobile contact. In its closed position in a network the mobile contact and the stationary contact of the circuit breaker are in contact with each other and the opening spring and the closing spring of the operating device are charged. Upon an opening command the opening spring opens the circuit breaker, separating the contacts. Upon a closing command the closing spring closes the circuit breaker and, at the same time, charges the opening spring. The opening spring is now ready to perform a second opening operation if necessary. When the closing spring has closed the circuit breaker, the electrical motor in the operating device recharges the closing spring. This recharging operation takes several seconds.

Illustrative examples of spring operated actuators for a circuit breaker can be found e.g. in U.S. Pat. No. 4,678,877, U.S. Pat. No. 5,280,258, U.S. Pat. No. 5,571,255, U.S. Pat. No. 6,444,934 and U.S. Pat. No. 6,667,452.

In known spring operated actuators axially acting springs, i.e. compression or tension helical springs are used. Also torsion springs such as torsion bars, helical springs and clock springs are used for the actuation of the opening and closing movements.

The use of axially acting springs is an arrangement that requires much space, in particular since the springs normally are directed at an angle to the drive shaft. Furthermore, these types of springs require mechanisms for converting the linear spring movements to rotational movements of the drive shaft. This increases the required number of moving parts in the actuator and thus makes it complicated.

Torsion springs are less frequently used for the actuators. Traditionally also these springs are located at an angle to the drive shaft or axially offset from the drive shaft. Known torsion spring operated actuators also have the axes of the opening spring and the closing spring axially offset in relation to each other.

Known spring operated actuators, whether employing axially acting or torsion springs, thus suffer from the drawbacks that they require much space and a relatively large amount of components.

With the term "end" related to a helical torsion spring is in this application meant the end of the spring material, i.e. the end in the direction of the spring helix. For the ends in the axial direction the term "axial end" is used.

SUMMARY OF THE INVENTION

The object of the present invention is to provide a spring operated actuator of the kind in question that requires small space and relatively few components, and thus overcomes the drawbacks entailing known actuators of this kind.

This object is achieved in that the opening spring means includes at least one opening torsion spring, defining an opening spring axis and an external opening spring diameter, the closing spring includes at least one closing torsion spring, defining a closing spring axis, which axes extend in the same direction and at a distance from each other that is smaller than 20% of the external opening spring diameter.

The two torsion springs that are arranged with their axes close to each other makes it possible to attain a compact construction of the actuator, and the number of components required to transmit the spring forces to the main shaft can be reduced in relation to conventional constructions. Preferably the distance between the axes is less than 10% of the external opening spring diameter.

According to a preferred embodiment the two axes are substantially aligned.

By having the axes aligned, i.e. at zero distance from each other, the above described advantages will be particularly accentuated. The construction will also be simpler than if there is a small distance between them.

According to a further preferred embodiment the aligned spring axes extend in the same direction as the axis of the main shaft.

Since the force transmitted from a torsion spring is tangentially directed in relation to the spring this embodiment further simplifies the connection to the drive shaft.

According to a further preferred embodiment the axis of the drive shaft is aligned with the spring axes.

This further contributes to simplify the connection of the springs to the drive shaft since the tangential forces from the springs directly can be transmitted as a tangential force on the drive shaft. Furthermore this embodiment minimizes the space requirements in the radial direction of the drive shaft.

According to a further preferred embodiment each of the torsion springs is a helical spring.

A helical spring in most cases is the most efficient type for storing and supplying mechanical energy in applications as in the present invention. In comparison e.g. with a clock spring the helical spring provides a larger freedom for an optimal relative location of the springs.

According to a further preferred embodiment the opening torsion spring has an inner diameter that is larger than the outer diameter of the closing torsion spring.

With this relationship between the diameters the closing torsion spring can be located completely or partly inside the opening torsion spring which further contributes to achieve a compact device.

According to a further preferred embodiment the opening torsion spring and the closing torsion spring are located with one of them radially outside the other and such that at least a major part of the opening torsion spring and a major part of the closing torsion spring have the same axial location.

This arrangement provides a very compact arrangement of the torsion springs which contributes further to achieve an actuator of small dimensions. Preferably the entire opening torsion spring and the entire closing torsion spring have the same axial location, since that will be the optimal arrangement with respect to save space.

According to a further preferred embodiment, the opening torsion spring is located outside the closing torsion spring.

This facilitates charging of the torsion springs where the opening torsion spring is recharged by the closing torsion spring and the latter is charged by an electrical motor or manually. Since the opening torsion spring normally operates at higher speed than the closing spring means it is a further advantage that this arrangement makes it simple to provide that the opening torsion spring acts on the main shaft with a larger radius than the closing torsion spring.

According to a further preferred embodiment the closing torsion spring includes a first torsion spring unit and a second spring unit, which first and second units are coaxial, at least a major portion of the first unit and a major portion of the second unit have the same axial location, the first unit is located radially outside the second unit and the first and second units are connected to each other adjacent one axial end of the closing torsion spring.

Through this embodiment the closing torsion spring has both its end, i.e. the frame supported end and the active end, adjacent one and the same axial end of the torsion spring. This further contributes to allow a compact design, a short axial extension of the closing spring and a low amount of components. It is preferred that the entire first unit and the entire second unit have the same axial location, since that minimizes the axial length of the closing spring and simplifies the actuation.

Although the two units can be made up by one single component, it is preferred that the two units are two separate components that are joined together by a spring force transmitting connection fitting. This simplifies the manufacturing of a closing torsion spring of this kind.

According to a further preferred embodiment each of the torsion springs defines a respective winding direction and an unwinding direction, and each of the torsion springs are arranged to be charged with mechanical energy in the unwinding direction and to discharge mechanical energy in the winding direction. This means that the torsion spring is compressed when it stores the energy, and the ends of the spring act by pushing in stead of pulling as in a conventional helical torsion spring. The connection of the spring ends to the support and the drive shaft thereby becomes less complicated in comparison with a mounting under tension instead of pressure.

According to a further preferred embodiment the spring operated actuator includes a rotary damper, having an axis that is aligned with the main shaft.

A rotary damper requires less space than a linear damper. When being aligned with the main shaft a particularly compact construction can be achieved.

According to a further preferred embodiment, the electrical switching apparatus is a circuit breaker for medium or high voltage.

A circuit breaker is an important application for the present invention and the advantages of the invention of the invention are particularly useful in the medium and high voltage range.

By medium voltage is conventionally meant a voltage level in the range of 1-72 kV and by high voltage is meant a voltage level above 72 kV, and these expressions have this meaning in the present application.

The invention also relates to an electric switching apparatus that includes a spring operated actuator according to the present invention, in particular to any of the preferred embodiments thereof. Preferably the switching apparatus is a circuit breaker and preferably the switching apparatus is a medium or high voltage switching apparatus.

The invented switching apparatus has corresponding advantages as those of the invented spring operated actuator and the preferred embodiments thereof, which advantages have been described above.

Preferred embodiments of the invention are specified herein. It is to be understood that further preferred embodiments of course can be realized by any possible combination of preferred embodiments mentioned above.

The invention will be further explained through the following detailed description of an illustrative example thereof and with reference to the accompanying drawings.

DETAILED DESCRIPTION OF THE INVENTION

Figure 1:
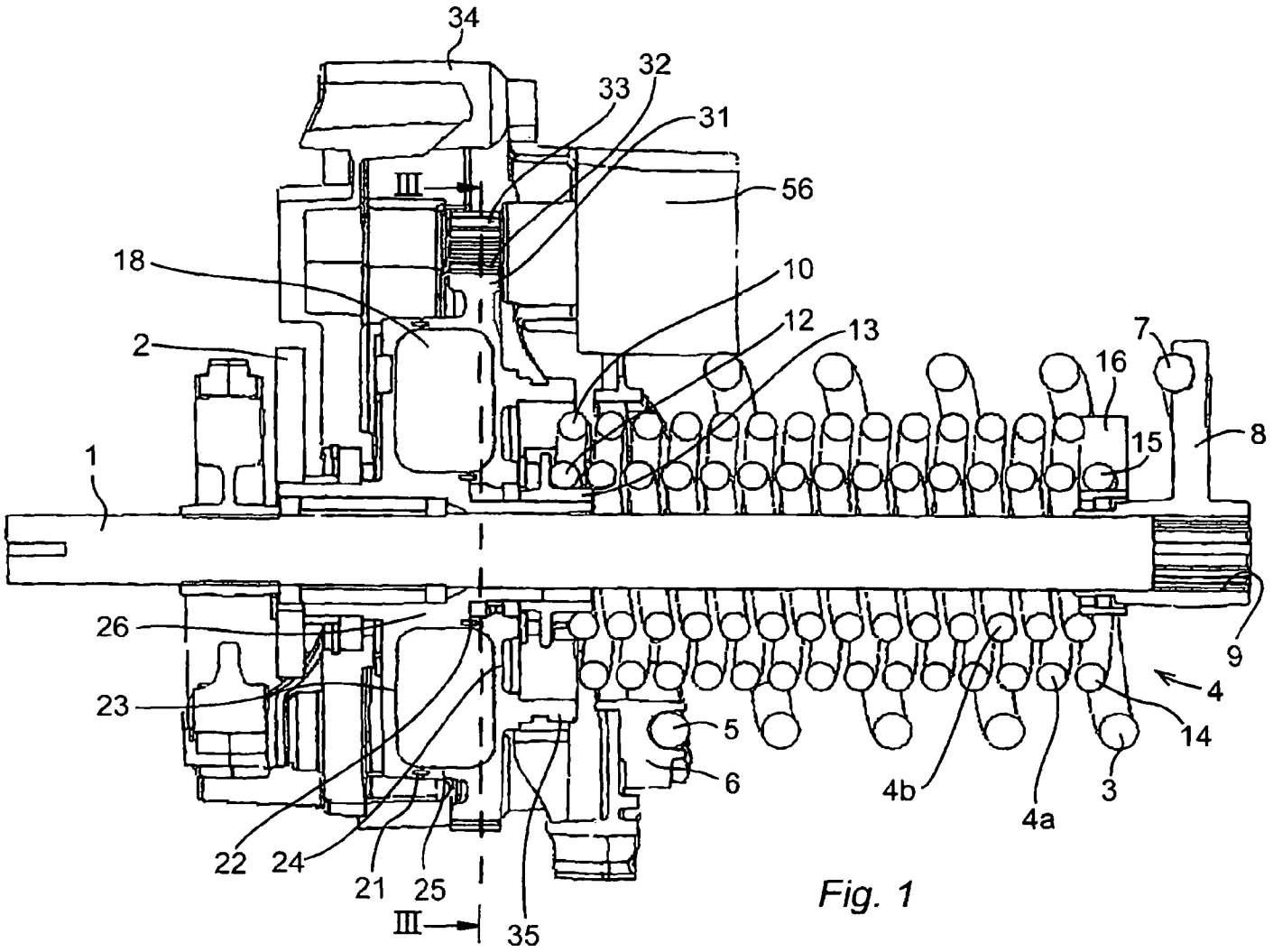
FIG. 1 is an axial section through an example of a spring operated actuator according to the invention.

FIG. 1 is an axial section through the actuator of a circuit breaker. The actuator has a main shaft 1 and a cam disc 2. The cam disc acts on the transmission rod (not shown) for switching the circuit breaker. The transmission from the cam disc to the circuit breaker and the circuit breaker as such can be of a conventional kind and need no further explanation.

The main shaft is operated by an opening spring 3 and a closing spring 4. Both the springs are helical torsion springs and are coaxial with the main shaft. The opening spring 3 is located radially outside the closing spring 4 and thus has an internal diameter exceeding the external diameter of the closing spring 4.

The opening spring 3 is squeezed between two end fittings, a supporting end fitting 6 at the supported end 5 of the spring and an actuating end fitting 8 at its actuating end 7. The opening spring 3 thus in its charged state is compressed in the direction of its helix, or otherwise expressed the charged opening spring is pressed in its unwinding direction. As a consequence the actuating end 7 is acting with a pushing force on the actuating end fitting 8, which is connected through splines 9 to the main shaft 1.

The closing spring 4 consists of two units, a radially outer unit 4*a* and a radially inner unit 4*b*, which both have axes aligned with the axis of the opening spring 3 and with the main shaft 1.

Like the opening spring also the closing spring 4 in its charged state is compressed in the direction of its helix. The outer unit 4*a* of the closing spring has a supported end 10 and a connection end 14, and the inner part has an actuating end 12 and a connection end 15. The supported end 10 is pressed against a supporting end fitting (not shown) which is mounted on a support flange 35, and the actuating end 12 is pressed against an actuating end fitting 13. The connection ends 14, 15 of the two units 4*a*, 4*b* are both pressed against a connection fitting 16, through which the two units are in force transmitting relation to each other.

When the circuit breaker is trigged for an opening action the opening spring 3 pushes its actuation end fitting 8 to rotate and thereby rotate the main shaft 1.

Some 0.3 seconds later the circuit breaker is to be closed. The closing spring 4 thereby is activated such that the actuating end 12 thereof pushes its actuating end fitting 13 to rotate the main shaft 1 in a direction opposite to that of the opening process to move the actuation rod, thereby closing the circuit breaker. When the main shaft 1 rotates in this direction it will also rotate the actuating end fitting 8 of the opening spring 3 in the same direction such that it pushes the actuating end 7 of the opening spring 3 and the opening spring becomes recharged and prepared for a consecutive opening movement should that be required.

When the closing operation is finished the closing spring is recharged in that its supported end 10 is pushed by its supporting end fitting.

At the ends of the opening and closing movements the movements have to be damped in order to avoid impact shocks at the end of the strokes due to excess of energy.

The opening movement is damped by a conventional linearly acting hydraulic damper 17.

The closing movement is damped by a rotary damper 18 having air as working medium. The rotary damper 18 has a toroidal working chamber, that is coaxial with the main shaft 1. The working chamber is formed by a housing having a first side wall 24, a second side wall 23, an outer circumferential wall 25 and an inner circumferential wall 26. The housing is spitted into two parts, a first part 20 and a second part 19. The two parts are rotatable relative to each other and are connected by an outer circumferential seal 21 and an inner circumferential seal 22.

The second part 19 is drivingly connected to the actuating end fitting 13 of the inner unit 4*b* of the closing spring 4 and thus rotates together with the cam disc 2 at closing. The first part 20 on its outside has an axially extending flange 35 on which the supporting end fitting of the outer unit 4*a* of the closing spring 4 is mounted.

Figure 3:
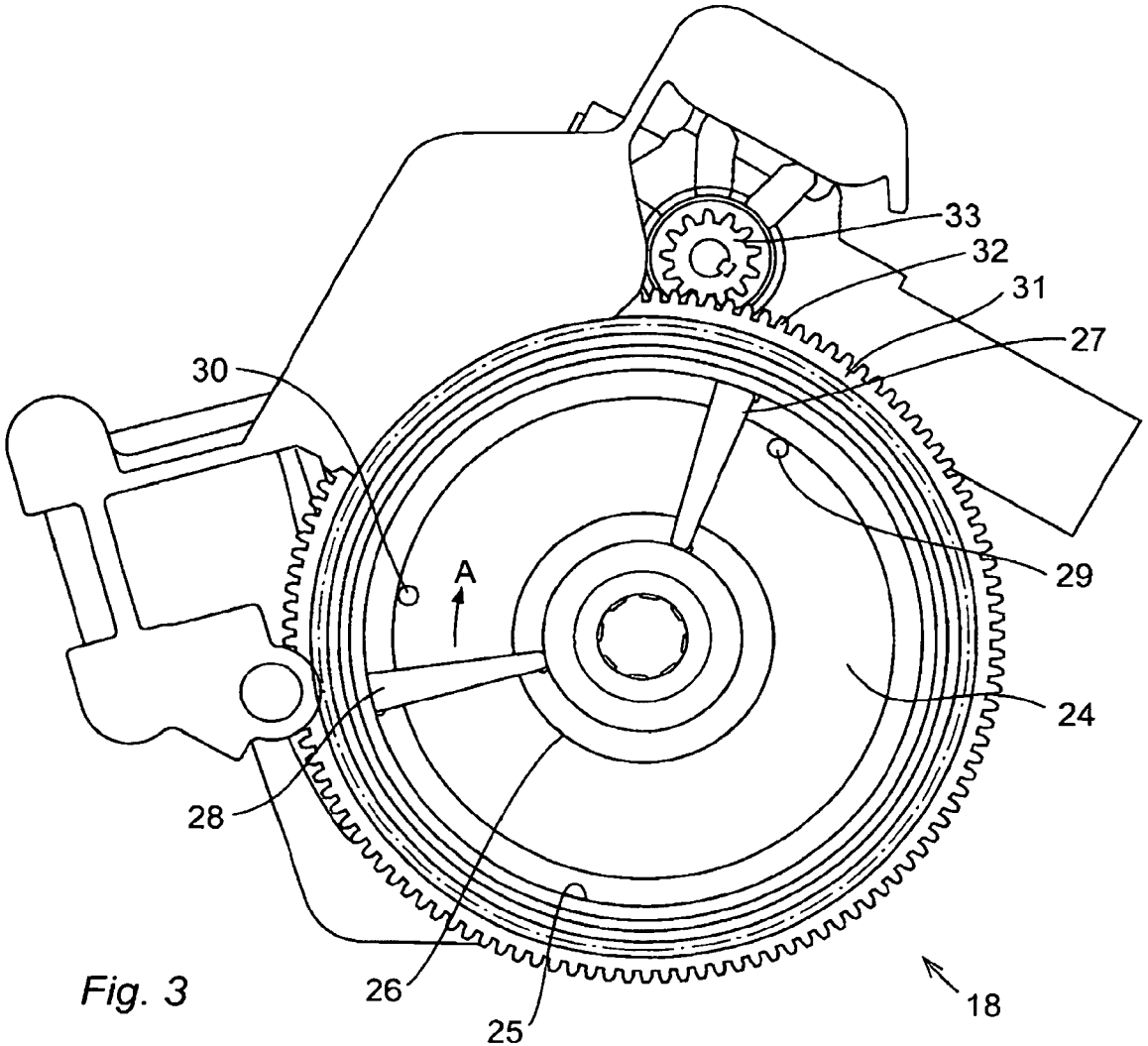
FIG. 3 is a section along line III-III in FIG. 1.

The operation of the closing damper is explained with reference to FIG. 3 which is a radial section through the damper in the direction towards the first part 20. During the closing movement the first part 20 is stationary and the second part 19 (not visible in FIG. 3) is rotating in direction of arrow A, defined as the rotational direction of the damper.

A disc-like body is attached to the first side wall 24, which forms a radial end wall 27. A corresponding disc-like body is attached to the second side wall 23 and forms a displacement body 28. Each of the end wall 27 and the displacement body 28 are sealingly cooperating with the side walls 23, 24 and the circumferential walls 25, 26 of the working chamber.

The first side wall has a first 29 and second 30 orifice there through to act as inlet and outlet respectively for air.

The inlet orifice 29 is located short after the end wall 27 as seen in the rotational direction of the damper. The outlet orifice 30 is located about a right angle ahead of the end wall 27.

When the closing spring is charged and in condition for initiating a closing movement the displacement body 28 is located closed to the end wall 27 on its right side as seen in the figure, i.e. in the area of the inlet orifice 29. The second part 19 of the housing is drivingly connected with the main shaft.

When a closing movement occurs the displacement body 28 will move from its initial position adjacent the end wall 27 since it is connected to the second side wall 23, and rotate in the direction of arrow A until it has made an almost complete turn and reaches the left side of the end wall 27. During its rotation air will be sucked in through the inlet orifice 29. And during the major part of the turn air will be pressed out through the outlet orifice 30.

After the displacement body has passed the outlet orifice 30 air will be trapped between the displacement body 28 and the end wall 27. Further rotation will compress the trapped air. Thereby an increasing counterforce against the rotation develops and some air leakage will occur along the sealing lines between the end wall 27 and the walls of the housing and between the displacement body 28 and the walls. Thereby the damping effect is achieved.

Normally the air leakage around the end wall and the displacement body is sufficient to attain a damping that is properly balanced between overdamping and underdamping. In case the seals are very effective a proper air leakage can be attained by providing a small leakage hole through the end wall 27 or through the displacement body 28.

Figure 4:
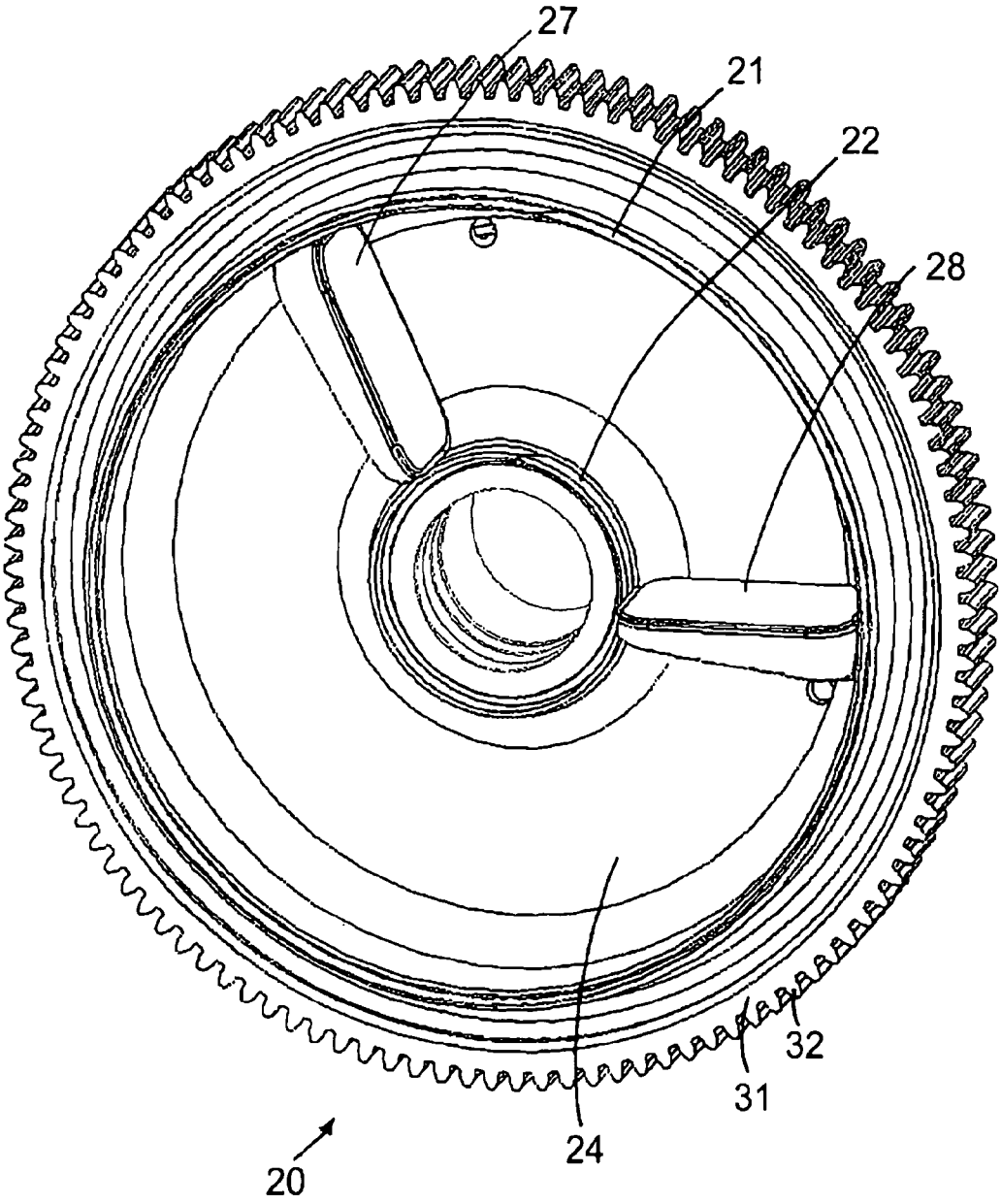
FIG. 4 is a perspective view of a detail of FIG. 3.

FIG. 4 is a perspective view of the first part of the housing of the closing damper.

The mechanism for charging the closing spring 4 is partly integrated with the closing damper 18. The first part 20 of the damper is externally shaped as a gear wheel 31 with external radially projecting teeth 32. The gear wheel 31 cooperates with a pinion 33 driven by an electric motor via a gear box 56. At charging, the pinion 33 drives the first part 20 of the damper 18 in the direction of arrow A (FIG. 3) about one complete turn. The end wall 27 thereby moves to a position immediately to the left of the displacement body 28. The end wall 27 and the displacement body thus will reach a position relative to each other as described above when the closing movement starts.

Figure 2:
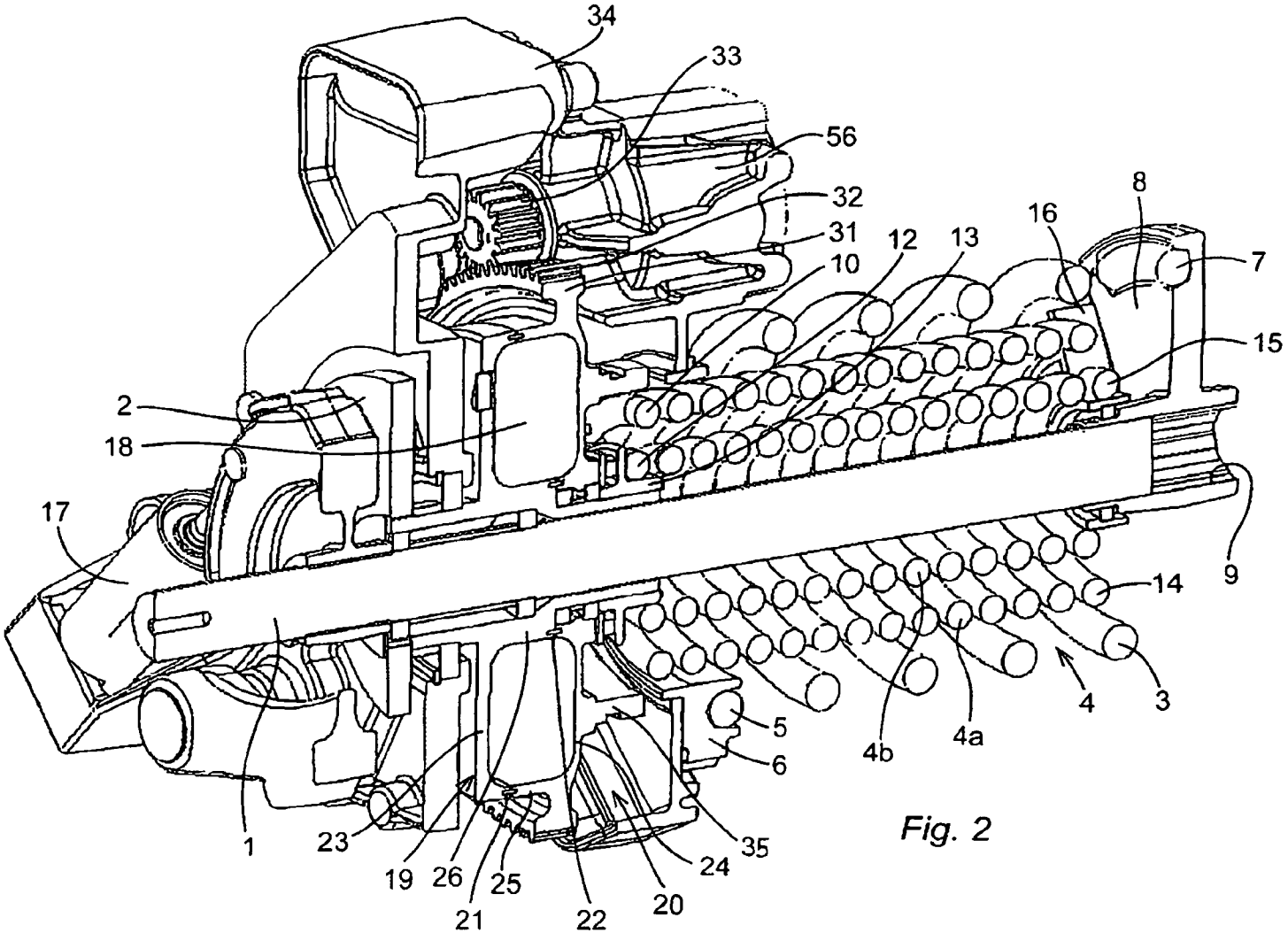
FIG. 2 is a perspective view of the section of FIG. 1.

The first part 20 of the damper 18 is through the flange 35 (FIGS. 1 and 2) drivingly connected to the supporting end fitting 11 of the outer unit 4*a* of the closing spring 4.

When the first part 20 rotates, the supporting end fitting of the outer unit 4*a* of the closing spring will follow its rotation since it is mounted on the axial flange 35 extending rearwards from the first part 20 of the damper 18. Thereby the closing spring is helically compressed to its charged state.

Figure 5:
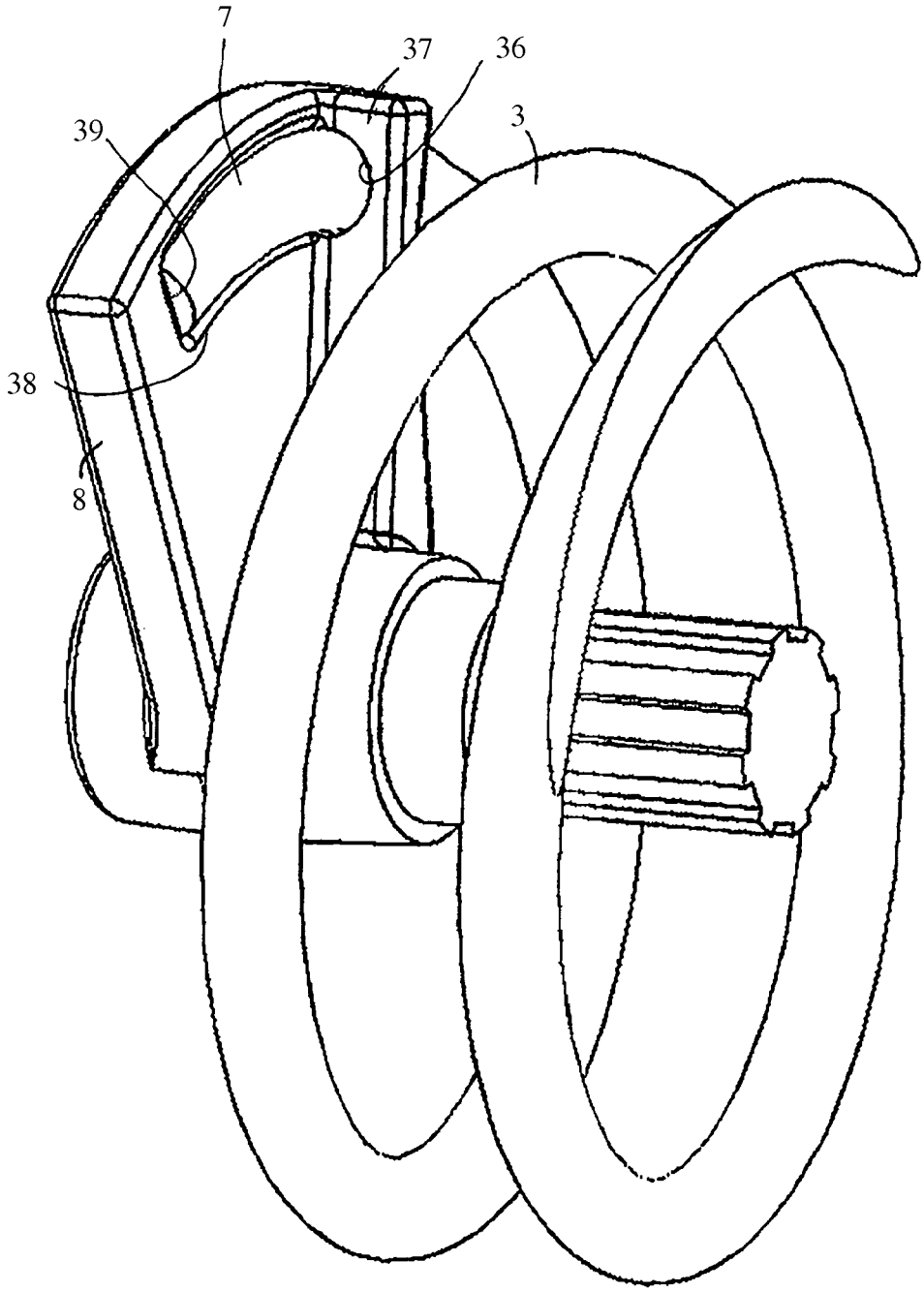
FIG. 5 is a perspective view of a detail of the spring operated actuator of FIG. 1-4.

FIG. 5 is a perspective view of the end fitting 8 of the opening spring 3 as seen from the spring towards the end fitting. The actuating end 7 of the opening spring 3 extends through a hole 36 in a flange 37 forming a part of the end fitting 8. A groove 38 in the end fitting 8 guides the actuating end 7 against an abutment surface 39. The other end fitting may have a similar construction.

Figure 6:
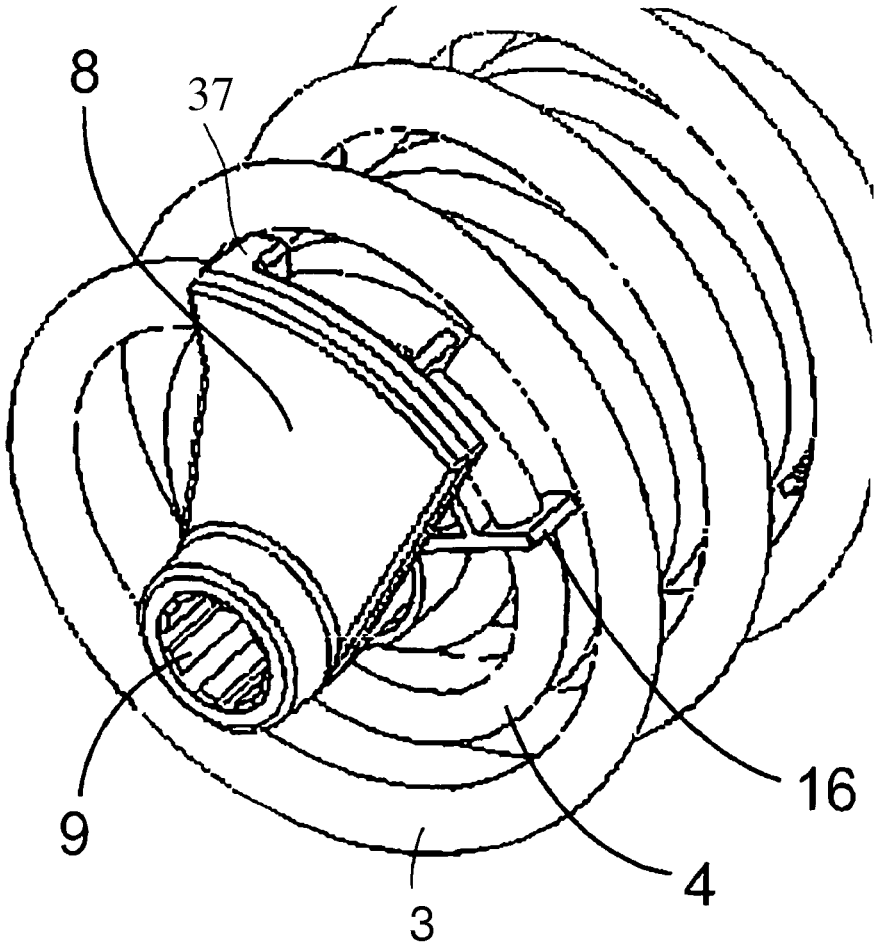
FIG. 6 is a perspective view of the detail in FIG. 5 from another direction.

FIG. 6 illustrates the actuating end fitting 8 of the opening spring 3 from another direction. Also the connection end fitting 16 of the units 4*a* and 4*b* is partly visible there behind.

Figure 7:
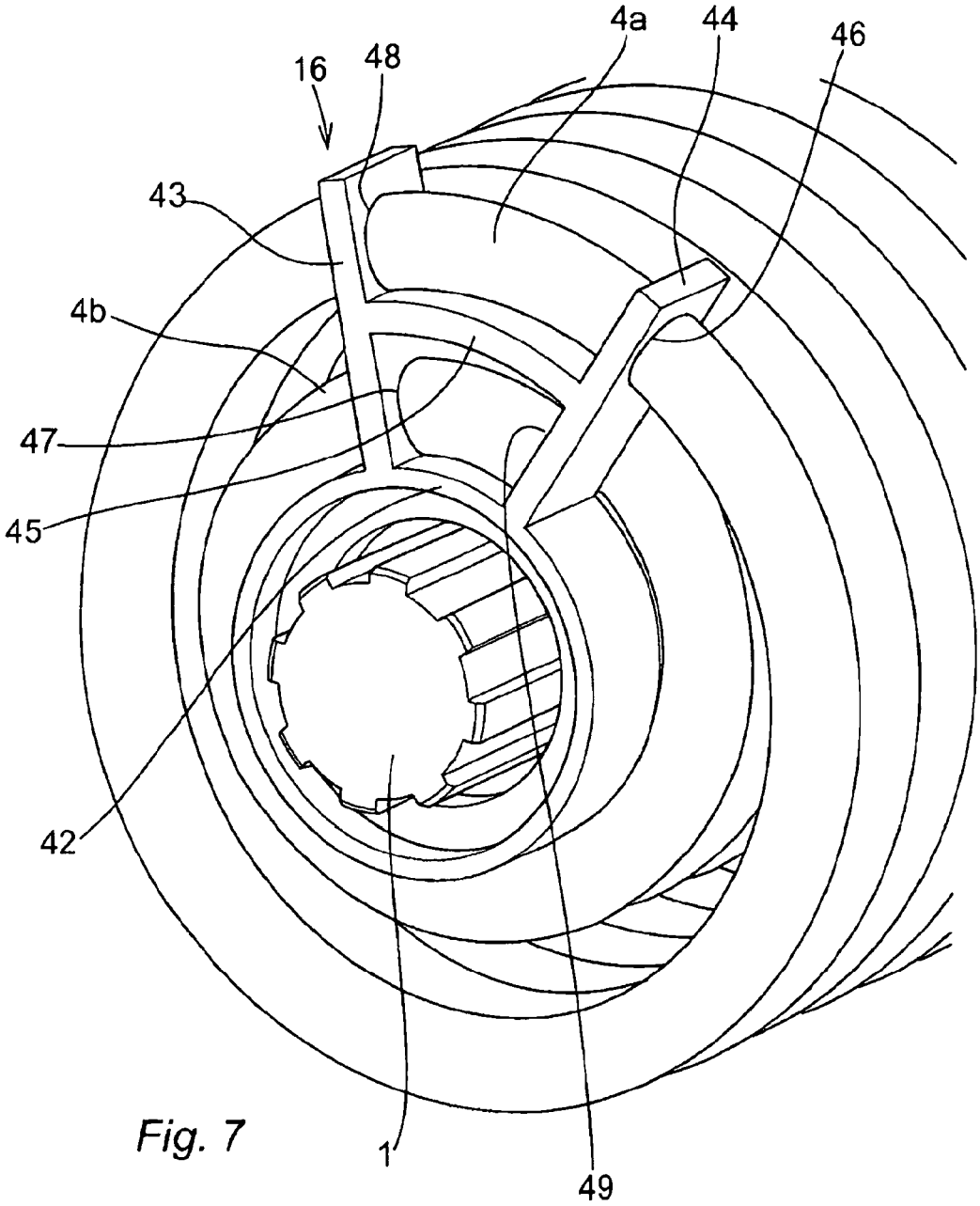
FIG. 7 is a perspective view of a further detail of the spring operated actuator of FIG. 1-6.

FIG. 7 illustrates the connection end fitting 16 more in detail. It consists of an inner ring 42 from which a first 43 and a second 44 abutment flange extend radially outwards at an angular position relative to each other of about 45-60°. At the radial middle of the abutment flanges 43, 44 a circular wall 45 interconnects them, which circular wall is coaxial with the inner ring 42. The first abutment flange 43 has an abutment surface 48 at its radially outer part and a hole 47 through its inner part. Correspondingly the second abutment flange 44 has a hole 46 through its outer part and an abutment surface 49 on its inner part.

The inner closing spring unit 4*b* extends through the hole 47 of the first flange 43, and its end abuts the abutment surface 49 of the second flange 44. Correspondingly the outer closing spring unit 4*a* extends through the hole 46 of the second flange 44, and its end abuts the abutment surface 48 of the first flange 43. A pushing force from the outer closing spring unit 4*a* thereby is transmitted to the inner closing spring unit 4*b*. The end portions of the closing spring units 4*a*, 4*b* are guided against its respective abutment surface 48, 49 by the holes 46, 47, the ring 42 and the circular wall 45. The end portions thereby can be loosely fitted into the connection end fitting 8 and no further attachment means is required.

Figure 8:
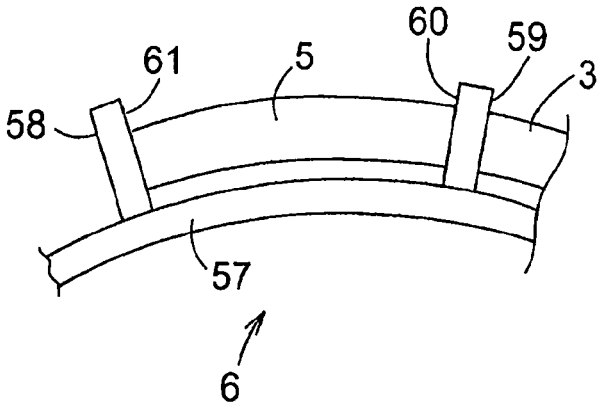
FIG. 8 is a side view of a part of a detail of FIG. 1-4 according to an alternative example.

An alternative construction of the end fittings is illustrated in FIG. 8. In FIG. 8 a part of the supporting end fitting 6 for the opening spring 3 is schematically illustrated. The supported end portion 5 of the opening spring 3 has an end surface against an abutment surface 61 on a radial flange 58 of the end fitting 6. A holding device is formed by a second radial flange 59 and a circumferential part 57 connecting the two flanges 58, 59. The second radial flange 59 has a hole 60 there through and the opening spring extends through this hole 60 such that its end portion 5 is directed towards the abutment surface 61. The other end fittings may have a similar construction.

Figure 9:
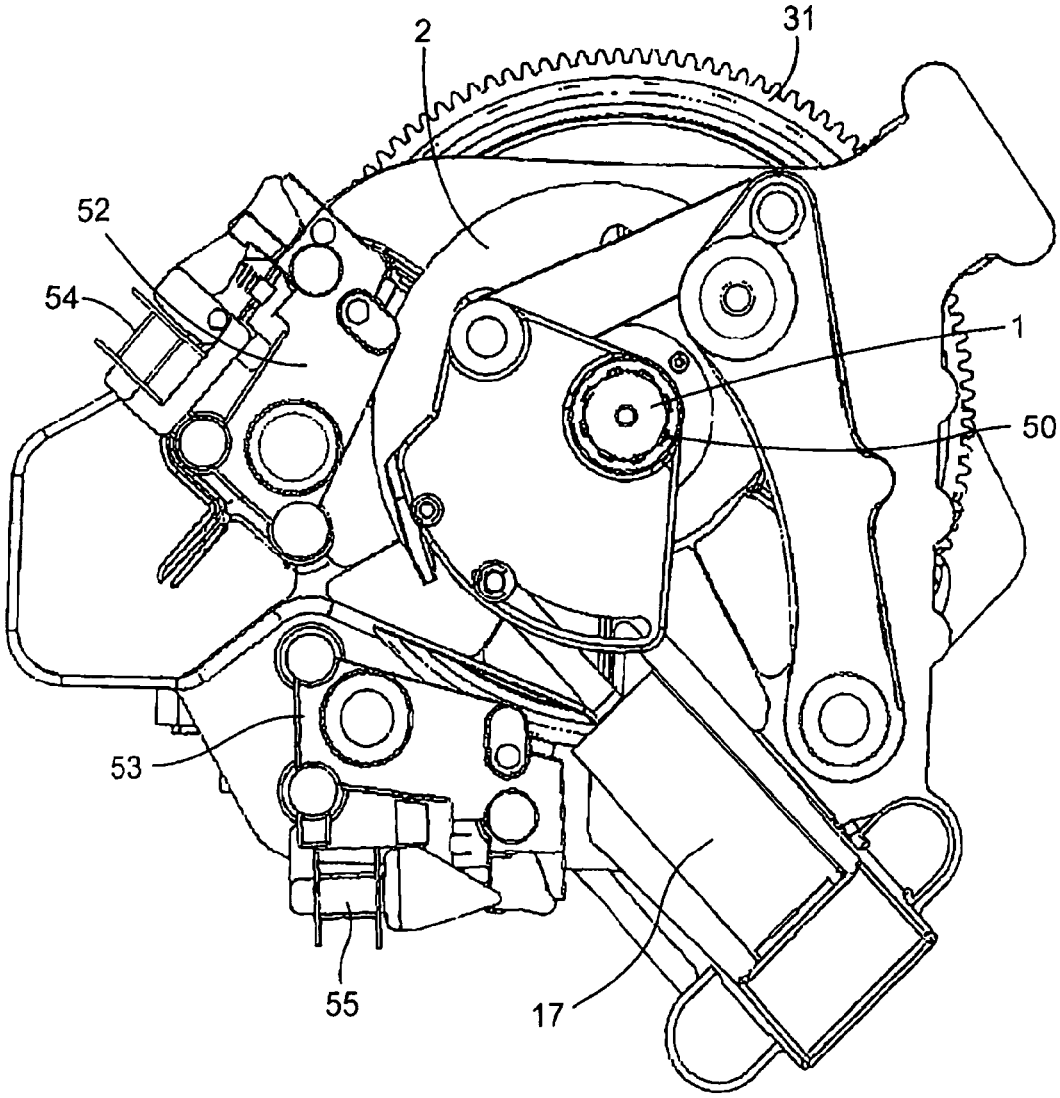
FIG. 9 is an end view of the spring operated actuator as seen from the left of FIG. 1.

FIG. 9 is an end view of the spring operated actuator as seen from the left in FIG. 1. The cam disc 2 is drivingly connected to the main shaft through splines 50. Latch mechanisms 52, 53 with a respective trigging coil 54, 55 control the opening and closing movements of the actuator. In the right part of the figure the oil damper 17 for the opening spring is visible, and to the left a part of the gear wheel 31 for charging the closing spring can be seen.

Figure 10:
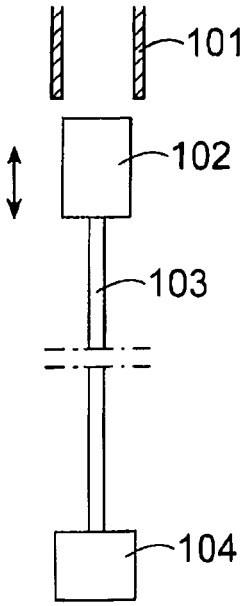
FIG. 10 is a schematic side view of a circuit breaker.

FIG. 10 schematically illustrates a circuit breaker where the movable contact part 102 is brought into and out of contact with the stationary contact part 101 by a rod 103 actuated by a spring operated actuator 104 according to the present invention. For a three phase breaker the actuator 104 can be arranged to simultaneously move the movable contact part 102 of each phase.

What is claimed is:

1. A spring operated actuator for an electrical switching apparatus, the spring operated actuator comprising:

a rotary drive main shaft arranged to transmit an actuating movement to the switching apparatus, an opening spring device, and a closing spring device, wherein said opening spring device includes at least one opening torsion spring, defining an opening spring axis and an external opening spring diameter, wherein said closing spring device includes at least one closing torsion spring, defining a closing spring axis, which axes extend in the same direction, each of said opening torsion spring and said closing torsion spring defining a respective winding direction and an unwinding direction, and each of said opening torsion spring and said closing torsion spring is arranged to be charged with mechanical energy in the unwinding direction and to discharge mechanical energy in the winding direction, and in that the axes extend at a distance from each other that is smaller than 20% of the external opening spring diameter.

2. The spring operated actuator according to claim 1 wherein the axes are substantially aligned.

3. The spring operated actuator according to claim 2 wherein the aligned spring axes extend in the same direction as the axis of the main shaft.

4. A spring operated actuator for an electrical switching apparatus, the spring operated actuator comprising:

a rotary drive main shaft arranged to transmit an actuating movement to the switching apparatus, an opening spring device, and a closing spring device, wherein said opening spring device includes at least one opening torsion spring, defining an opening spring axis and an external opening spring diameter, wherein said closing spring device includes at least one closing torsion spring, defining a closing spring axis, which axes extend in the same direction at a distance from each other that is smaller than 20% of the external opening spring diameter;

wherein the axes are substantially aligned, the aligned spring axes extend in the same direction as the axis of the main shaft, and the axis of the main shaft is aligned with the spring axes.

5. The spring operated actuator according to claim 4 wherein each of the torsion springs is a helical spring.

6. The spring operated actuator according to claim 5 wherein the opening torsion spring has an inner diameter that is larger than the outer diameter of the closing torsion spring.

7. The spring operated actuator according to claim 5 wherein the opening torsion spring and the closing torsion spring are located with one of them radially outside each other and such that at least a major part of the opening torsion spring and a major part of the closing torsion spring have the same axial location.

8. The spring operated actuator according to claim 7 wherein the opening torsion spring is located outside the closing torsion spring.

9. The spring operated actuator according to claim 1 wherein the closing torsion spring includes a first torsion spring unit and a second spring unit, which first and second units are coaxial, in that at least a major portion of the first unit and a major portion of the second unit have the same axial location, in that the first unit is located radially outside the second unit and in that the first and second units are connected to each other adjacent one axial end of the closing torsion spring.

10. The spring operated actuator according to claim 1 wherein the spring operator actuator includes a rotary air damper, having an axis that is aligned with the main shaft.

11. The spring drive device according to claim 1 wherein the electrical switching apparatus is a circuit breaker for medium or high voltage.

12. An electrical switching apparatus comprising:

a spring operated actuator, the spring operated actuator including a rotary drive main shaft arranged to transmit an actuating movement to the switching apparatus, an opening spring device, and a closing spring device, wherein the opening spring device includes at least one opening torsion spring, defining an opening spring axis and an external opening spring diameter, and wherein the closing spring device includes at least one closing torsion spring, defining a closing spring axis, the opening spring axis and the closing spring axis extend at a distance from each other that is smaller than 20% of the external opening spring diameter.

13. The electrical switching apparatus according to claim 12 wherein the switching apparatus is a circuit breaker.

14. The electrical switching apparatus according to claim 12 wherein the switching apparatus is a medium or a high voltage switching apparatus.

15. The electrical switching apparatus according to claim 12 wherein each of the torsion springs is a helical spring.

16. The electrical switching apparatus according to claim 15 wherein the opening torsion spring has an inner diameter that is larger than the outer diameter of the closing torsion spring.

17. The electrical switching apparatus according to claim 15 wherein the opening torsion spring and the closing torsion spring are located with one of them radially outside each other and such that at least a major part of the opening torsion spring and a major part of the closing torsion spring have the same axial location.

18. The electrical switching apparatus according to claim 17 wherein the opening torsion spring is located outside the closing torsion spring.

19. The electrical switching apparatus according to claim 17 wherein the opening spring axis and the closing spring axis extend in the same direction and are substantially aligned with each other, and extend in the same direction as and are aligned with the axis of the main shaft.

* * * * *